US007854822B2

(12) United States Patent
Chmielewski et al.

(10) Patent No.: US 7,854,822 B2
(45) Date of Patent: Dec. 21, 2010

(54) PLASTICIZING FORMULATION FOR FLUFF PULP AND PLASTICIZED FLUFF PULP PRODUCTS MADE THEREFROM

(75) Inventors: Harry J. Chmielewski, Brunswick, GA (US); Othman A. Hamed, Jesup, GA (US); Michael Haeussler, Savannah, GA (US)

(73) Assignee: Rayonier TRS Holdings Inc., Jessup, GA (US)

( * ) Notice: Subject to any disclaimer, the term of this patent is extended or adjusted under 35 U.S.C. 154(b) by 0 days.

(21) Appl. No.: 11/001,566

(22) Filed: Dec. 2, 2004

(65) Prior Publication Data

US 2006/0118258 A1 Jun. 8, 2006

(51) Int. Cl.
*D21F 11/00* (2006.01)
*A61F 13/15* (2006.01)
*A61F 13/20* (2006.01)

(52) U.S. Cl. ..... 162/157.6; 162/111; 604/367; 604/368

(58) Field of Classification Search ..... 162/9, 162/111, 157.6; 604/367, 368
See application file for complete search history.

(56) References Cited

U.S. PATENT DOCUMENTS 3,395,708 A * 8/1968 Hervey et al. ..... 604/375
3,554,862 A 1/1971 Hervey et al.
3,677,886 A 7/1972 Forssblad et al.
3,809,604 A 5/1974 Estes et al.
4,098,996 A 7/1978 Ryan et al.
4,144,122 A 3/1979 Emanuelsson et al.
4,303,471 A 12/1981 Laursen
4,432,833 A 2/1984 Breese
4,731,269 A 3/1988 Hansen et al.
5,547,541 A 8/1996 Hansen et al.
5,766,752 A * 6/1998 Cox et al. ..... 428/322.2
5,866,242 A 2/1999 Tan et al.
5,922,451 A * 7/1999 Cox et al. ..... 428/323
6,458,343 B1 * 10/2002 Zeman et al. ..... 424/63
6,766,817 B2 7/2004 Da Silva
6,872,674 B2 * 3/2005 Williams et al. ..... 442/416
2003/0040695 A1 * 2/2003 Zhao et al. ..... 604/15
2004/0177935 A1 * 9/2004 Hamed et al. ..... 162/9

OTHER PUBLICATIONS

Electronic Mail Message from Elson Silva, Ph.D., dated May 17, 2006 with alleged explanation of relevance. [Note: Applicants and their counsel did not prepare, modify or otherwise alter this explanation, which was apparently prepared by Dr. Silva, and therefore expressly disclaim any representation(s) regarding the accuracy of that explanation.].

* cited by examiner

*Primary Examiner*—Melanie J Hand
(74) *Attorney, Agent, or Firm*—Hunton & Williams LLP

(57) ABSTRACT

A plasticizing formulation for producing plasticized fluff pulp. The plasticizing formulation, which preferably is an aqueous solution, includes a primary plasticizing agent, and optionally a secondary plasticizing agent. Preferably, the primary plasticizing agent is 1,4-cyclohexanedimethanol, and the secondary plasticizing agent is triacetin. When the plasticizing formulation is applied to a cellulosic fluff pulp, a plasticized fluff pulp is produced. The resultant plasticized fluff pulp may have one or more of the following: reduced Kamas energy, Mullen strength, and fiber knot and nit contents, when compared to the base cellulosic fluff pulp fiber that is not plasticized.

51 Claims, 6 Drawing Sheets

PLASTICIZING FORMULATION FOR FLUFF PULP AND PLASTICIZED FLUFF PULP PRODUCTS MADE THEREFROM

BACKGROUND OF THE INVENTION

1. Field of the Invention

Embodiments of the invention are directed to a formulation and method for making plasticized fluff pulp that is partially de-bonded, soft, and resilient. Other embodiments are directed to absorbent materials made from such plasticized fluff pulp to be used as an absorbent core in absorbent articles such as disposable diapers, feminine hygiene products, and incontinence devices. More specifically, embodiments of the invention are directed to a plasticized fluff pulp that is useful in making absorbent core material that is soft, flexible, resilient and free of hard spots.

2. Description of Related Art

Products containing absorbent fluff pulps are used in a wide variety of personal care products. These range from absorbent articles such as personal hygiene products to wipes or pads used in medical and food handling applications. Incorporation of superabsorbent materials into absorbent articles intended for personal hygiene products has led to a noteworthy reduction in the use of fluff pulp, but the continued growth of feminine hygiene and incontinence device markets has ensured that there is a continued need for absorbent fluff pulp.

While the design of individual absorbent articles varies depending upon intended use, there are certain elements or components common to such articles. Absorbent articles intended for personal care, such as adult incontinent pads, feminine care products, and infant diapers typically are comprised of at least a top sheet, a back sheet, an absorbent core positioned between the top sheet and back sheet, and an optional acquisition/distribution layer positioned between the top sheet and the absorbent core. The function of the absorbent core is to absorb and store body fluids entering the absorbent article through the top sheet layer. Because the origin of body fluids is localized, it is desirable to provide a means for distributing fluid throughout the dimensions of the absorbent core to optimize the use of the available absorbent material. This is typically accomplished either by providing an acquisition/distribution member positioned between the top sheet and absorbent core and/or altering the composition of the absorbent core per se.

The acquisition/distribution layer typically is incorporated in the absorbent articles to provide better distribution of liquid, increased rate of liquid absorption, reduced gel blocking, and improved surface dryness. Acquisition/distribution layers usually are comprised of, for example, acquisition fibers or other material that retains small amounts of fluid. A wide variety of acquisition fibers are known in the art. Included among these are synthetic fibers, a composite of cellulosic fibers and synthetic fibers, and cross-linked cellulosic fibers.

The absorbent core is typically comprised of a wood fluff pulp that is capable of absorbing large quantities of fluid and retaining a small amount of fluid. Absorbent cores can be designed in a variety of ways to enhance fluid absorption and retention properties. By way of example, the fluid retention characteristics of absorbent cores can be greatly enhanced by distributing superabsorbent materials among the wood fluff pulp fibers. Superabsorbent materials or polymers (SAP) are well known in the art as substantially water-insoluble, water-swellable materials capable of absorbing water in quantities up to 100 times their weight or more. Absorbent cores for hygienic products, particularly diapers and adult incontinence products, are usually manufactured on a continuous production line in which wood fluff pulp is provided in roll form (usually manufactured by wet-laid process) and is defiberized by mechanical means, such as a hammermill. The defiberized fluff pulp then is conveyed to a forming area where it is air-laid with particles of SAP, in a predetermined ratio, to form an air-laid absorbent core. The air-laid absorbent core is either inserted into an absorbent article, or wound on a roll for later introduction to the manufacturing of an absorbent article.

Typically, absorbent articles are designed to be absorbent, thin and flexible. In recent years, as consumer demand for less expensive and less bulky disposable absorbent products has increased, manufacturers have sought effective ways to reduce the size and cost of the products without sacrificing the fluid transport properties or structural integrity of the products during use. Notably, absorbent articles have become progressively thinner over the last decade. For example, the thickness of a feminine hygiene pad has been reduced from about 15 mm to 20 mm in the mid 1980's to about 2.5 mm to 6 mm today. Unfortunately, the shift to thin and ultra thin products has not been without manufacturing problems. For instance, as the products became thinner, absorbent cores lost integrity. To counter this, absorbent article designers have tried to produce higher integrity cores, such as by compressing the core to a high density and/or use bonding agents to achieve fiber-to-fiber and fiber-to-SAP particle bonding. However, the increased density and increased usage of SAP in these products has caused problems with liquid acquisition and wicking rates. Moreover, compressing the absorbent core to a high density can cause the core to develop hard spots (clusters of SAP and fibers with very high density) that are undesirable to consumers.

In an attempt to overcome these problems, debonding agents such as those disclosed in U.S. Pat. Nos. 3,554,862; 3,677,886; 3,809,604; 4,144,122 and 4,432,833 have been used. Debonding agents usually are quaternary ammonium compounds containing one or more fatty groups that soften and lubricate the fibers. When applied to a sheet of wood pulp fibers, the fatty groups disrupt the inter-fiber hydrogen bonding (fiber-to-fiber bonding)—as a result, voids are created among the fibers. These voids enhance the bulk of the fibers, thereby producing a softer and weaker sheet of wood pulp. Similarly, cationic materials such as those disclosed in U.S. Pat. Nos. 3,554,862; 3,677,886; 3,809,604; 4,144,122 and 4,432,833 and nonionic agents such as BEROCELL 587 (available from Eka Chemicals, Inc.) also have been used on wood pulp. The use of non-ionic agents, such as fatty acid esters, in combination with cationic retention agents has been disclosed, for example, in U.S. Pat. No. 4,303,471, and is known to produce good disintegration properties for wood pulp. Unfortunately, the long hydrophobic alkane chains in these softening and debonding agents tend to have undesirable hydrophobic effects on pulps. For example, they tend to decrease the absorbency and wettability of the pulp, thereby rendering the pulp unsuitable for applications such as absorbent articles, where high absorbency and fast wicking are desirable. Moreover, the softened and de-bonded fluff pulps tend to form more hard spots than conventional untreated fluff pulp when calendered with SAP particles.

Another proposed solution for improving softness of densified absorbent cores is to use mercerized fibers. The use of mercerized fibers to enhance the softness of the absorbent cores has been disclosed in U.S. Pat. No. 5,866,242. However these fibers are expensive when compared to non-mercerized fibers.

As an alternative to the use of additives or mercerized fibers, plasticizing agents such as those disclosed in U.S. Pat. Nos. 4,098,996; 5,547,541; and 4,731,269 also have been used as a softener for wood pulp. Typically, a plasticizing agent is added to a pulp slurry prior to forming wet-laid sheets. The plasticizing agent is added in large quantities of at least 10 weight % of pulp. The resulting pulp sheet usually lacks stiffness, and is easy to densify when air-laid to a non-woven pad. Common plasticizing agents include polyhydroxy compounds such as glycerol; low molecular weight polyglycols such as polyethylene glycols and polypropylene glycols; and other polyhydroxy compounds. Ammonia, urea, and alkylamines are also known to plasticize wood pulp (see A. J. Stamm, Forest Products Journal 5(6):413, 1955). One draw-back to these plasticizers is that they need to be added to the pulp slurry in large quantities, which has an adverse effect on the wet-strength of the absorbent core. Moreover, in order to provide beneficial properties to pulp these additives have to be added to the pulp during the wet-laying process.

The description herein of certain advantages and disadvantages of known cellulosic fibers, treatment compositions, and methods of their preparation, is not intended to limit the scope of the present invention. Indeed, the present invention may include some or all of the methods, fibers and compositions described above without suffering from the same disadvantages.

SUMMARY OF THE INVENTION

In view of the difficulties presented by softening and debonding cellulosic pulp, there remains a need in the art for a simple, relatively inexpensive, plasticizing formulation suitable for making soft, pliable cellulosic fluff pulp without sacrificing absorbency and liquid transport properties of the fluff pulp. In addition, there is a need for cellulosic fluff pulp that produces a soft, flexible and thin absorbent material that maintains absorbency, liquid transport, and structural integrity properties. The resultant plasticized cellulosic fluff pulp also preferably is essentially free of hard spots. There also exists a need for a process of making the plasticized fluff pulp in the sheet form which provides time and cost savings to both the pulp manufacturer and the manufacturer of the absorbent article. The present invention desires to fulfill these needs and to provide further related advantages, although the invention is not limited solely to compositions, methods, and materials that fulfill these or other needs.

It is therefore a feature of an embodiment of the invention to provide a plasticizing formulation comprising a primary plasticizing agent that is water soluble, non-ionic and non-polymeric and that functions as a plasticizer and debonder for cellulosic fibers.

It is also a feature of an embodiment of the invention to provide an antimicrobial plasticizing formulation comprising a primary plasticizing agent, a secondary plasticizing agent and an antimicrobial agent It also is a feature of an embodiment of the invention to provide a method for making plasticized fluff pulp, that includes the steps of providing a cellulosic fluff pulp base fiber, providing a plasticizing formulation, and applying the plasticizing formulation to the cellulosic fluff pulp base fiber. The plasticized fluff pulp formed by this method preferably has a reduced Kamas energy, and a reduced knot and nit content when compared to the cellulosic base fiber. The plasticized fluff pulp formed by this method also preferably has an absorbent capacity, an absorbency under load, and a centrifugal retention capacity that is not significantly lower than that of the cellulosic base fiber. It is also a feature of an embodiment of the invention to provide an absorbent core and an absorbent article that include a plasticized fluff pulp.

These and other objects, features and advantages of the present invention will appear more fully from the following detailed description of the preferred embodiments of the invention, and the attached drawings.

DETAILED DESCRIPTION OF EMBODIMENTS

Figure 1:
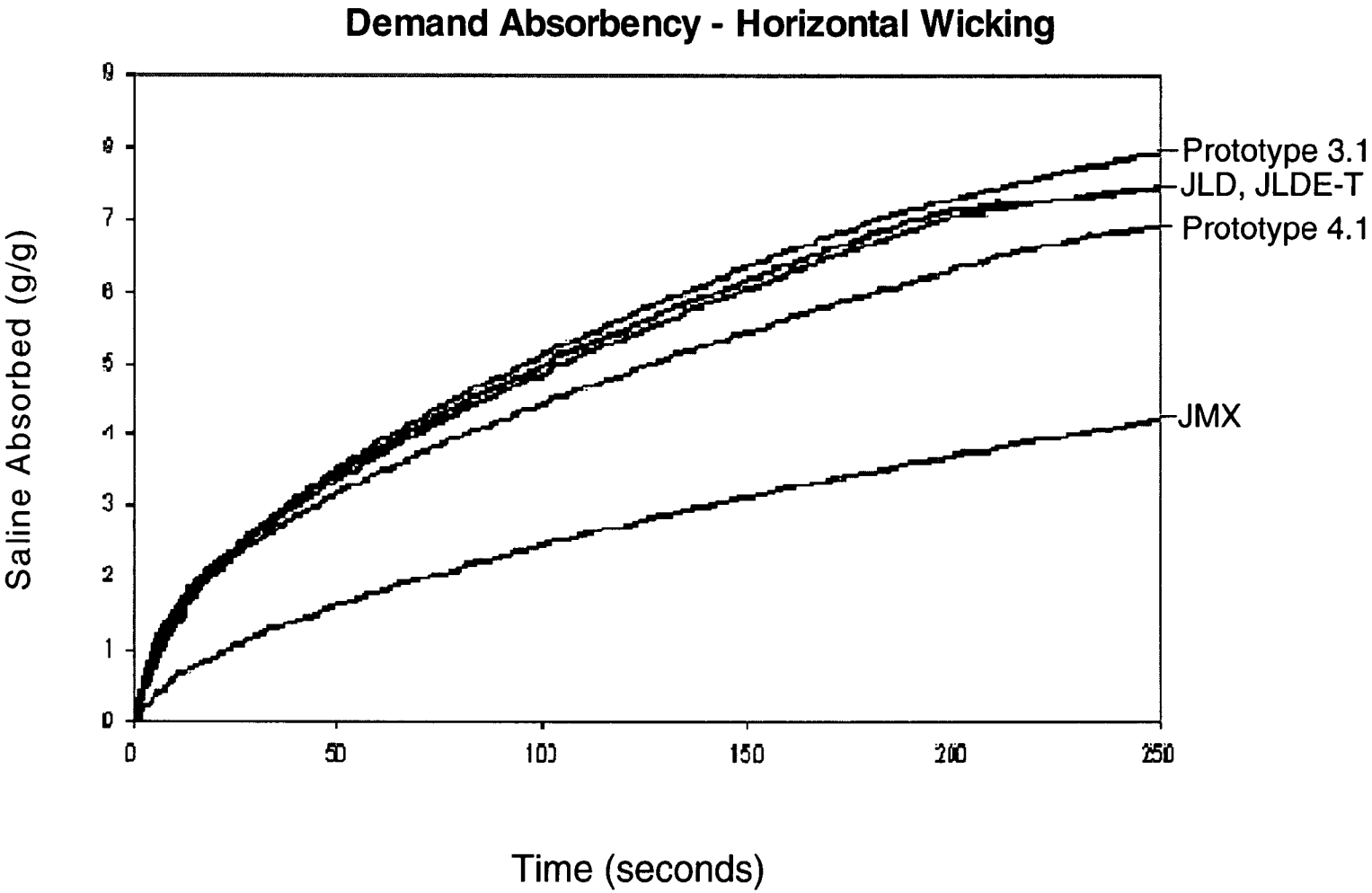
FIG. 1 is a plot showing the horizontal wicking rate of plasticized and conventional fluff pulp as described in Example 4.

Embodiments of the invention relate to a plasticized fluff pulp suitable for use in an absorbent article, and to a method of making the plasticized fluff pulp. The method preferably comprises treating cellulosic fluff pulp fibers with an aqueous solution of a plasticizing formulation.

As used herein, the terms and phrases "absorbent garment," "absorbent article" or simply "article" or "garment" refer to mechanisms that absorb and contain body fluids and other body exudates. More specifically, these terms and phrases refer to garments that are placed against or in proximity to the body of a wearer to absorb and contain the various exudates discharged from the body. A non-exhaustive list of examples of absorbent garments includes diapers, diaper covers, disposable diapers, training pants, feminine hygiene products and adult incontinence products. Such garments may be intended to be discarded or partially discarded after a single use ("disposable" garments). Such garments may comprise essentially a single inseparable structure ("unitary" garments), or they may comprise replaceable inserts or other interchangeable parts.

Embodiments of the present invention may be used with all of the foregoing classes of absorbent garments, without limitation, whether disposable or otherwise. Some of the embodiments described herein provide, as an exemplary structure, a diaper for an infant, however this is not intended to limit the invention. The invention will be understood to encompass, without limitation, all classes and types of absorbent garments, including those described herein.

The term "component" can refer, but is not limited, to designated selected regions, such as edges, corners, sides or the like; structural members, such as elastic strips, absorbent pads, stretchable layers or panels, layers of material, or the like.

Throughout this description, the term "disposed" and the expressions "disposed on," "disposed above," "disposed below," "disposing on," "disposed in," "disposed between"

and variations thereof are intended to mean that one element can be integral with another element, or that one element can be a separate structure bonded to or placed with or placed near another element. Thus, a component that is "disposed on" an element of the absorbent garment can be formed or applied directly or indirectly to a surface of the element, formed or applied between layers of a multiple layer element, formed or applied to a substrate that is placed with or near the element, formed or applied within a layer of the element or another substrate, or other variations or combinations thereof.

Throughout this description, the phrases "top sheet" and "back sheet" denote the relationship of these materials or layers with respect to the absorbent core. It is understood that additional layers may be present between the absorbent core and the top sheet and back sheet, and that additional layers and other materials may be present on the side opposite the absorbent core from either the top sheet or the back sheet.

Throughout this description, the expressions "upper layer," "lower layer," "above" and "below," which refer to the various components included in the absorbent material are used to describe the spatial relationship between the respective components. The upper layer or component "above" the other component need not always remain vertically above the core or component, and the lower layer or component "below" the other component need not always remain vertically below the core or component. Other configurations are contemplated within the context of the present invention.

Throughout this description, the term "impregnated" insofar as it relates to a plasticizing formulation impregnated in a fiber, denotes an intimate mixture of the plasticizing formulation and cellulosic fluff pulp fiber, whereby the plasticizing formulation may be adhered to the fibers, adsorbed on the surface of the fibers, or linked via chemical, hydrogen or other bonding (e.g., Van der Waals forces) to the fibers. Impregnated in the context of the present invention does not necessarily mean that the plasticizing formulation is physically disposed beneath the surface of the fibers.

Throughout this description, the expression "nip density" is used to describe the density of an absorbent core that has been compressed in a sheet press having a fixed nip gap. The nip density of an absorbent core is determined by dividing the basis weight of the absorbent core by the nip gap of the press.

Throughout this description, the expression "final density" is used to describe the density of an absorbent core that has been compressed in a sheet press having a fixed nip gap, and then has been left sitting for about ten minutes to reach equilibrium density. The final density of an absorbent core is determined by dividing the basis weight of the absorbent core by the final (equilibrium) thickness of the absorbent core.

Throughout this description, the expression "hard spots" is used to refer to clusters of SAP and fibers that have no resiliency. Hard spots tend to form in a traditional absorbent core when the core is compressed to a high density.

Throughout this description, the expression "plasticized fluff pulp" is used to refer to fluff pulp that has been treated with a plasticizing agent formulation, and that is useful for making an absorbent core free of hard spots.

Throughout this description, the term "resiliency" is used to refer to the ability of the fluff pulp to recover or spring back after being compressed by common methods, thus indicating the absorbent core structural integrity.

Embodiments described herein concern plasticized fluff pulp in sheet or fluff form that is useful in absorbent articles, and in particular, that is useful in forming absorbent cores in the absorbent article. The particular construction of the absorbent article is not critical to the present invention, and any absorbent article can benefit from this invention. Suitable absorbent garments are described, for example, in U.S. Pat. Nos. 5,281,207, and 6,068,620, the disclosures of each of which are incorporated by reference herein in their entirety including their respective drawings. Those skilled in the art will be capable of utilizing plasticized fluff pulp of the present invention in absorbent garments, cores, acquisition layers, and the like, using the guidelines provided herein.

An embodiment of the plasticizing formulation useful in making the plasticized fluff pulp preferably is composed of a primary plasticizing agent, or a combination or mixture of a primary plasticizing agent and a secondary plasticizing agent. The plasticizing formulation may be prepared by any suitable and convenient procedure. Preferably, the plasticizing formulation is present in an aqueous solution, diluted to a predetermined concentration.

Primary plasticizing agents useful in the plasticizing formulation may include materials that are water soluble (e.g., greater than 10%), non-ionic, and can function as debonder and plasticizer for fluff pulp. While any primary plasticizing agent having these properties can be used in embodiments, suitable primary plasticizing agents include, for example, polyhydroxy compounds containing a hydrophobic alkyl group and the ethers and esters derivatives of the polyhydroxy compounds, where the hydrophobic alkyl group is an alkyl moiety with 3 or more carbon atoms. The alkyl group may include saturated, unsaturated (e.g., alkenyl, alkynyl, allyl), substituted, un-substituted, branched and un-branched, cyclic, and acyclic compounds. Examples of such a primary plasticizing agent include but are not limited to: 1,2-cyclohexanedimethanol, 1,3-cyclohexanedimethanol, 1,4-cyclohexanedimethanol (1,4-CHDM), diacetin, tri(propylene glycol), di(propylene glycol), tri(propylene glycol) methyl ether, poly(ethylene glycol) methyl ether, pentaerythritol ethoxylate, pentaerythritol propoxylate, 2-phenoxyethanol, phenethyl alcohol and combinations and mixtures thereof. Preferably, the primary plasticizing agent is not triacetin.

A secondary plasticizing agent may be any plasticizing agent, and preferably is a plasticizing agent known in the art that is capable of reducing the defiberization energy of cellulosic fluff pulp. The secondary plasticizing agent can be relatively insoluble in water (e.g., less than 10%) but soluble in an aqueous solution of the primary plasticizing agent (where the solution contains from about 1% to about 99% by weight of the primary plasticizing agent). Examples of a secondary plasticizing agent suitable for use in an embodiment of the plasticizing formulation include the ether- and ester-derivatives of the polyhydroxy compounds containing a hydrophobic alkyl group, where the hydrophobic alkyl group is an alkyl moiety with 3 or more carbon atoms. The alkyl group may include saturated, unsaturated (e.g., alkenyl, alkynyl, alkyl), substituted, un-substituted, branched and un-branched, cyclic, and acyclic compounds. Examples of such a secondary plasticizing agent include but are not limited to: triacetin, propylene carbonate, tri(propylene glycol) butyl ether, di(propylene glycol) butyl ether, di(propylene glycol) dimethyl ether, propyleneglycol diacetate, phenethyl acetate, and combinations and mixtures of thereof.

Preferably the plasticizing formulation comprises a primary plasticizing agent that is 1,4-cyclohexanedimethanol (1,4-CHDM), and more preferably the plasticizing formulation comprises a mixture of 1,4-CHDM as a primary plasticizing agent, with triacetin as a secondary plasticizing agent.

The inventors have unexpectedly discovered that 1,4-CHDM is an effective plasticizing agent for the use in softening cellulosic fluff pulp (i.e., so that it does not form hard spots when mixed with SAP and calendered to form an absorbent core). In addition, the inventors found 1,4-CHDM to have no adverse effect on absorbency or wettability of the cellulosic fluff pulp, which contradicts conventional industry practice and knowledge.

1,4-CHDM is a water-soluble organic material with a melting point of about 46° C. It is biodegradable, and is believed to be useful as a plasticizing agent in resins, in powder coatings, and as a solvent for cosmetic and personal care products. 1,4-CHDM also is believed to enhance the fluffing properties of the cellulosic fluff pulp fibers by reducing both inter-fiber and intra-fiber hydrogen bonding. Without being limited to a specific theory, 1,4-CHDM molecules appear to act as "wedges" which disrupt the inter- or intra-fiber hydrogen bonding among fibers and cellulose chains. (See K. D. Sears, et. al., Vol. 27 of Journal of Applied Polymer Science, pp. 4599-4610 (1982)). As such, 1,4-CHDM can occupy the hydrogen bonding sites on the cellulose chain or fiber, thereby increasing the porosity and the resiliency of the fiber. The resiliency of the fiber prevents the cellulosic fluff pulp from collapsing and forming hard spots when subjected to calendering in the presence of superabsorbent particles.

The plasticizing formulation may include other additives such as, for example, brighteners, odor absorbents, and/or flame retardants. Examples of suitable flame retardant additives include, for example, sodium phosphate, ammonium hydrogen phosphate, boric acid, calcium chloride, ammonium sulfate, sodium bisulfate, sodium tetraborate decahydrate, sodium hydrogen phosphate, and ammonium carbonate. The flame retardant additive can be applied to the fiber with the plasticizing solution. Alternately, the flame retardant may be applied to the fiber separately, either before or after the addition of the plasticizing solution to the cellulosic fibers.

Examples of suitable odor absorbents include baking soda, talc powder, cyclodextrin, ethylenediamine tetra-acetic acid or other chelating agents, zeolites, activated silica, activated carbon granules and antimicrobial agents. Preferably, the odor control agent is an antimicrobial agent. Any substances active against gram-negative bacteria are particularly suitable as antimicrobial agents according to the invention. Examples of gram-negative bacteria include *Escherichia coli, Staphylococcus aureus* and *Klebsiella pneumoniae*. The active substances according to the invention include, for example, silver-loaded zeolites such as those sold under the trademark HEALTHSHIELD™, chitosan or chitin derivatives, encapsulated perfumes, emollients such as lanolin, iodine/iodophors, chlorhexidine, phenols, phospholipids, 4-chloro-3,5-dimethylphenol, 5-chloro-2-(2,4-dichlorophenoxy) phenol, trichlorocarbanalide, hexachlorophene, chlorhexidine, o-phenylphenol, benzylquaternium salts, 4-hydroxybenzoic acid and its salts with alkali or alkaline earth metals or its esters with linear or branched $C_{1-10}$alcohols, N-(4-chlorophenyl)-N'-(3,4-dichlorophenyl)-urea, 2,4,4'-trichloro-2'-hydroxy diphenyl ether (triclosan), 4-chloro-3,5-dimethyl phenol, 2,2'-methylene-bis-(6-bromo-4-chlorophenol), 3-methyl-4-(1-methylethyl)-phenol, 2-benzyl-4-chlorophenol, 3-(4-chloropenoxy)-propane-1,2-diol, 3-iodo-2-propinyl butyl carbamate, chlorohexidine, 3,4,4'-trichlorocarbanilide (TTC), piroctone ethanolamine salt (commercially available under the trade name OCTOPIROX from the Clariant Corporation, Mount Holly (West) N.J.), tetracycline, 3,4,4'-trichlorobanilide, antimicrobial perfumes such as, for example, eugeniol, geraniol, oil of lemon grass, limonene thymol or menthol, glycerol monolaurate (GML), diglycerol monocaprate (DMC), zinc salts such as, for example, zinc glycinate, zinc lactate or zinc phenol sulfonate, phytosphingosines, dodecane-1,2-diol, undecylenic acid, its salts with alkali or alkaline earth metals or its esters with linear or branched $C_{1-10}$alcohols, salicylic acid-N-alkyl amides where the alkyl groups contain 1 to 22 carbon atoms linear or branched and mixtures thereof. Particularly preferred antimicrobial agents according to the invention are salicylic acid-N-octyl amide and/or salicylic acid-N-decyl amide, 2,4,4'-trichloro-2'-hydroxydiphenyl ether (triclosan), 4-chloro-3,5-dimethylphenol, OCTOPIROX, tetracycline, 3,4,4'-trichlorobanilide, and antimicrobially active perfumes.

Preferably, the plasticizing formulation comprises from about 0.25% to about 50% by weight antimicrobial agent, more preferably comprises about 1% to about 15%, and most preferably comprises about 2% to about 12.5% by weight antimicrobial agent.

It is preferable that an antimicrobial-containing plasticizing formulation contains low quantities of water and the primary plasticizing agent, more preferably an antimicrobial-containing plasticizing formulation contains no water and very little, if any, of the primary plasticizing agent. Without being limited to a specific theory, it is believed that this is because typical antimicrobial agents (e.g., triclosan) are hydrophobic in nature, and do not dissolve well in the presence of water and/or the primary plasticizing agent. In addition, a hydrophobic solution generates a more uniform distribution of antimicrobial agent on the fiber and provides better penetration into the interior part of the fiber. Without being limited to a specific theory, it is believed that this is because a hydrophobic material such as, for example, triacetin does not swell the fiber; instead it travels throughout the pores and among the fibers, enabling it to be distributed more evenly on the fibers. Therefore, in one embodiment, a plasticizing formulation that contains an antimicrobial agent comprises from about 1 weight % to about 10 weight % of a primary plasticizing agent, from about 5 weight % to about 95 weight % of a secondary plasticizing agent, and from about 0.25 weight % to about 50.0 weight % of an antimicrobial agent.

Another embodiment provides a method for making plasticized fluff pulp using the plasticizing formulation of the present invention. The method preferably comprises applying the plasticizing formulation to cellulosic fluff fibers. Preferably, the plasticizing formulation is in an aqueous solution (the "plasticizing solution") containing about 0.2 weight % to about 99 weight % of the plasticizing formulation, more preferably containing about 0.5 weight % to about 80 weight % of the plasticizing formulation, and most preferably containing about 1 weight % to about 60 weight % of the plasticizing formulation. The plasticizing solution may be prepared by any suitable and convenient procedure. The plasticizing solution can be added to the fluff pulp so that a predetermined amount of the plasticizing formulation is provided to the fiber. In other words, the amount of plasticizing solution added to the fluff pulp can depend upon the concentration of the plasticizing formulation in the solution, and the desired ratio of plasticizing formulation to fiber.

In one preferred embodiment, the plasticizing solution comprises a primary plasticizing agent. Preferably, the primary plasticizing agent is present at about 5 weight % to about 99 weight % of the solution. In other preferred embodiments, the plasticizing solution comprises a combination of a primary plasticizing agent, and a secondary plasticizing agent. Preferably the primary and secondary plasticizing agents are mixed in a weight ratio of about 1.0:4.0 to about 4.0:1.0 and are diluted with water to a predetermined concentration to form the plasticizing solution. Preferably, the plasticizing solution comprises about 5 weight % to about 60 weight % of the primary plasticizing agent, and about 5 weight % to about 60 weight % of the secondary plasticizing agent. More preferably, the plasticizing solution comprises about 30 weight % to about 60 weight % of the primary plasticizing agent, and about 30 weight % to about 60 weight % of the secondary plasticizing agent.

Preferably, the plasticizing solution comprises a mixture of 1,4-CHDM as the primary plasticizing agent, and triacetin or alkyl acid esters of citric acid as the secondary plasticizing agent. More preferably the plasticizing solution comprises 1,4-CHDM and triacetin. It has been found that when a plasticizing solution containing 1,4-CHDM and triacetin is applied to fluff pulp sheets by spraying, the sheets showed about a 10%-30% reduction in Mullen strength and Kamas energy. In addition, absorbent cores formed from the resultant plasticized fluff pulp showed no signs of hard spots.

In a preferred embodiment, the plasticizing solution also includes an odor controlling agent, such as an antimicrobial agent. The odor controlling agent preferably is included in an effective amount. The expression "effective amount" as herein defined means a level sufficient to prevent odor in absorbent article such as for example diaper, or prevent growth of microorganisms present in urine, for a definite period of time. Preferred levels of odor controlling agent will provide from about 0.001% to about 0.5%, more preferably from about 0.002% to about 0.1%, most preferably from about 0.003% to about 0.06%, by weight based on the total weight of the fiber.

Optionally, the fluff pulp may be pre-treated with an antimicrobial agent. Preferably the antimicrobial agent is dissolved in a non-aqueous solvent and then applied to the fluff pulp. Especially preferred solvents are those known to soften the fluff pulp such as for example triacetin, diacetin, propylene carbonate, and the like. Preferably, the antimicrobial agent is applied onto the fluff pulp with the plasticizing solution.

As used herein, the expressions "fluff pulp" and "fluff pulp fibers" refer to those cellulosic fluff pulps which are conventionally employed to form a web for use, for example, in absorbent articles. Any cellulosic fluff pulp can be used in the invention, so long as it provides the physical characteristics of the fibers described above. Suitable cellulosic fluff pulps for use in forming the plasticized fluff pulp of the present invention include those derived primarily from wood pulp. Suitable wood pulp can be obtained from any of the conventional chemical processes, such as the Kraft and sulfite processes. Preferred fibers are those obtained from various soft wood pulp such as Southern pine, White pine, Caribbean pine, Western hemlock, various spruces, (e.g. Sitka Spruce), Douglas fir or mixtures and combinations thereof. Fibers obtained from hardwood pulp sources, such as gum, maple, oak, eucalyptus, poplar, beech, and aspen, or mixtures and combinations thereof also may be used, as well as other cellulosic fiber derived form cotton linter, bagasse, kemp, flax, and grass. The fluff pulp fiber can be comprised of a mixture of two or more of the foregoing cellulose pulp products. Particularly preferred fibers for use in the plasticized fluff pulp of the present invention are those derived from wood pulp prepared by the Kraft and sulfite-pulping processes.

The cellulosic fluff pulp used in the embodiments described herein also may be pretreated prior to use. This pretreatment may include physical treatment such as subjecting the fibers to steam, caustic, chemical treatment or CTMP (chemi-thermomechanical pulp treatment). For example, the fluff pulp fibers may be cross-linked using any of a variety of cross-linking agents such as dimethyl dihydroxyethylene urea and alkane poly acids. Commercially available caustic extractive pulp suitable for use in embodiments of the present invention include, for example, Porosanier-J-HP, available from Rayonier Performance Fibers Division (Jesup, Ga.), and Buckeye's HPZ products, available from Buckeye Technologies (Perry, Fla.). The fluff pulp fibers may also be twisted or crimped, as desired.

The cellulosic fluff pulp suitable for use in embodiments described herein may be provided in any of a variety of forms. For example, one aspect of the present invention contemplates using fluff pulp in sheet, roll, or fluff form. In another aspect of the invention, the fluff pulp can be in a mat of non-woven material, such as stabilized resin-bonded or thermal-bonded non-woven mat. Fluff pulp in mat form is not necessarily rolled up in a roll form, and typically has a density lower than fibers in the sheet form. In yet another feature of an embodiment of the invention, the fluff pulp can be used in the wet or dry state. It is preferred that the fluff pulp be employed in the dry state.

The expression "pulp sheet" as used herein refers to cellulosic fiber sheets formed using a wet-laid process. The sheets typically have a basis weight of about 200 to about 800 gsm and density of about 0.3 g/cc to about 1.0 g/cc. The pulp sheets are subsequently defiberized in a hammermill to convert them into fluff pulp before being used in an absorbent product. Pulp sheets can be differentiated from tissue paper or paper sheets by their basis weights. Typically, tissue paper has a basis weight of from about 5 to about 50 gsm and paper sheets have basis weights of from about 47 to about 103 gsm, both lower than that of pulp sheets.

The application of the plasticizing solution to the cellulosic fluff pulp fiber may be performed in a number of ways. One embodiment relates to a method of applying the plasticizing solution by dipping the fluff pulp in sheet or fluff form into a plasticizing solution, pressing the plasticized pulp, and drying it. Another embodiment comprises the steps of adding the plasticizing solution to a fluff pulp slurry. Other embodiments of the present invention comprise applying the plasticizing solution to wet or dry fluff pulp by spraying, rolling or printing onto fluff pulp in sheet or fluff form. In yet another embodiment, the plasticizing solution can applied to the fluff pulp at any convenient point in the wet-laying manufacturing process of the fluff pulp. Another embodiment involves spraying the plasticizing solution onto defiberized fluff pulp during the manufacturing of the absorbent core. Preferably, the plasticizing solution is sprayed onto partially dried or dried fluff pulp in sheet form. It should be noted that application of a plasticizing formulation to fluff pulp is not limited to application in solution, and can also include application in pure form, or as an emulsion, suspension or dispersion thereof.

After application of the plasticizing solution to the fiber, the plasticizing formulation is preferably present on the fiber in an amount of from about 0.05 weight % to 5 weight % based on the fiber weight. More preferably, the plasticizing formulation is present in an amount from about 0.2 weight % to about 3 weight %, and most preferably present in an amount from about 0.5 weight % to 2 weight % based on the fiber weight. In one preferred embodiment, after application of the plasticizing solution to the fiber, the resultant fiber contains from about 0.05 weight % to about 3 weight % of the plasticizing formulation, and from about 0.003 weight % to about 0.06 weight % of an antimicrobial agent.

It is preferred that after application of the plasticizing solution to the fiber, the primary agent is present in an amount from about 0.1 weight % to about 5.0 weight %, based on the total weight of the fiber. It is preferable that, after application of the plasticizing solution to the fiber, the secondary agent is present in an amount from about 0.05 weight % to about 3 weight %, based on the total weight of the fiber. In one preferred embodiment, after application of the plasticizing solution to the fiber, the resultant fiber contains from about 0.1 weight % to about 5 weight % 1,4-CHDM, from about 0.05 weight % to about 3.0 weight % triacetin, and from about 0.003 weight % to about 0.06 weight % of an antimicrobial agent. In another preferred embodiment, after application of the plasticizing solution to the fiber, the resultant fiber contains from about 0.05 weight % to about 3.0 weight % triacetin, and from about 0.003 weight % to about 0.06 weight % of an antimicrobial agent.

One benefit of the embodiments described herein is that the plasticized fluff pulp possesses improved softness characteristics over the un-plasticized cellulosic fluff pulp. Preferably, the application of the plasticizing formulation to cellulosic fluff pulp reduces the Kamas energy and Mullen strength of the pulp, while having a negligible effect on absorbency under load, and absorbent capacity. The application of the plasticizing formulation to cellulosic fluff pulp also preferably improves wicking and fluid retention of the fibers.

For instance, it has been found that the plasticized fluff pulp prepared in accordance with the embodiments has a lower Kamas energy than the same cellulose fluff pulp that was not plasticized. Preferably, the Kamas energy of the plasticized fluff pulp is reduced by 5%, more preferably by 10%, and most preferably by 15% in comparison to the Kamas energy of the conventional un-plasticized cellulosic fluff pulp. The Kamas energy of the plasticized fluff pulp preferably is at least about 2 Wh/kg less than the Kamas energy of the conventional un-plasticized fluff pulp, more preferably is at least about 5 Wh/kg less than the Kamas energy of the un-plasticized fluff pulp, and most preferably is at least about 10 Wh/kg less than the Kamas energy of the un-plasticized fluff pulp. Those of ordinary skill in the art will appreciate, however, that the plasticized fluff pulp of the embodiments described herein may have other previously described advantageous properties, but have little or no change in Kamas energy, or even an increase in Kamas energy.

Further, it has been found that the plasticized fluff pulp prepared in accordance with the embodiments has a lower Mullen strength than the un-plasticized cellulosic fluff pulp. The Mullen strength of the plasticized fluff pulp of the present invention preferably is at least about 25 kPa less than, more preferably at least about 50 kPa less than, and most preferably at least about 100 kPa or more less than the Mullen strength of the conventional un-plasticized cellulosic fluff pulp. Preferably, the Mullen strength of the plasticized fluff pulp is reduced by 2%, more preferably by 5%, even more preferably by 10%, and most preferably by 20% in comparison to the Mullen strength of the un-plasticized cellulosic fluff pulp. Again, skilled artisans will appreciate that the plasticized fluff pulp of the embodiments described herein may have other previously described advantageous properties, but have little or no change in Mullen strength, or even an increase in Mullen strength.

In contrast to fibers treated with conventional softening or debonding agents, the plasticized fluff pulp prepared in accordance with embodiments may have improved fluid transport properties characterized by improvement of liquid wicking, when compared to the native fiber. Wicking is defined as the distance that liquid travels through a sheet of fluff pulp per unit time. The wicking of the plasticized fluff pulps of the present invention are preferably increased by more than 0.25 cm/min, more preferably by more than 0.5 cm/min, and most preferably, by more than 1.0 cm/min over the wicking of the conventional de-bonded fluff pulp.

Moreover, the centrifuge retention of the plasticized fluff pulps prepared in accordance with the embodiments also may be increased over the un-plasticized cellulosic fluff pulp. Centrifuge retention of the plasticized fluff pulp, measured in grams retained per gram of pulp (g/g), preferably increases by more than 0.10 g/g, more preferably by more than 0.2 g/g over the centrifuge retention of the conventional un-plasticized cellulosic fluff pulp. Those skilled in the art will appreciate that the plasticized fluff pulp of the embodiments described herein may have other previously described advantageous properties, but have little or no change in centrifuge retention or wicking.

In certain aspects of embodiments, the plasticizing formulation may be added to cellulosic fluff pulp to soften it without regard to the effect, if any, on the absorbency of the fluff pulp.

The plasticized fluff pulp prepared in accordance with embodiments described herein is particularly useful in making a softened absorbent core, used to manufacture consumer products such as diapers, feminine hygiene products or incontinence products. The phrase "absorbent core" as used herein refers to a matrix of cellulose pulp fibers that are capable of absorbing large quantities of fluid. Absorbent cores can be designed in a variety of ways to enhance fluid absorption and retention properties. By way of example, the fluid retention characteristics of absorbent cores can be greatly enhanced by disposing superabsorbent materials amongst fibers of the cellulose pulp.

The expressions "superabsorbent polymer" ("SAP") and "superabsorbent material" as used herein refer to any polymeric material that is capable of absorbing large quantities of fluid by forming a hydrated gel. Superabsorbent polymers are well-known to those skilled in the art as substantially water-insoluble, absorbent polymeric compositions that are capable of absorbing large amounts of fluid (e.g., 0.9% solution of NaCl in water, or blood) in relation to their weight and forming a hydrogel upon such absorption. Superabsorbent polymers also can retain significant amounts of liquid under moderate pressures. Superabsorbent polymers generally fall into three classes, namely, starch graft copolymers, cross-linked carboxymethylcellulose derivatives, and modified hydrophilic polyacrylates. Examples of such absorbent polymers are hydrolyzed starch-acrylonitrile graft copolymer; a neutralized starch-acrylic acid graft copolymer, a saponified acrylic acid ester-vinyl acetate copolymer, a hydrolyzed acrylonitrile copolymer or acrylamide copolymer, a modified cross-linked polyvinyl alcohol, a neutralized self-cross-linking polyacrylic acid, a cross-linked polyacrylate salt, carboxylated cellulose, and a neutralized cross-linked isobutylene-maleic anhydride copolymer. An absorbent material of the present invention can contain any commonly-known or later-developed SAP. The SAP can be in the form of particulate matter, flakes, fibers and the like. Exemplary particulate forms include granules, pulverized particles, spheres, aggregates and agglomerates. Exemplary and preferred SAP's include salts of crosslinked polyacrylic acid such as sodium polyacrylate.

It is preferred in embodiments that the plasticized fluff pulp is present in the absorbent core in an amount ranging from about 20 weight % to about 100 weight %, based on the total weight of the absorbent core. More preferably, the plasticized fluff pulp is present in the absorbent core from about 60 weight % to about 100 weight %. The absorbent core also preferably contains about 0 weight % to about 80 weight % SAP, and more preferably contains from about 10 weight % to about 80 weight % SAP. The superabsorbent polymer may be distributed throughout the absorbent core within the voids in the fiber. In another embodiment, the superabsorbent polymer may be attached to plasticized fluff pulp using a binding agent such as, for example, a material capable of attaching the SAP to the fiber via hydrogen bonding, (see, for example, U.S. Pat.

No. 5,614,570, the disclosure of which is incorporated by reference herein in its entirety).

The absorbent core or composite may comprise one or more layers that may comprise plasticized fluff pulp. In one embodiment, one or more layers of the absorbent core comprise a mixture of plasticized fluff pulp with conventional cellulosic fibers and SAP. Preferably, the plasticized fluff pulp comprises about 10 weight % to about 80 weight % of the one or more layers, and more preferably comprises about 20 weight % to about 60 weight % of the one or more layers, based on the total weight of the layer. Preferably, the plasticized fluff pulp is present in the fiber mixture in an amount ranging from about 1% to 70% by weight, based on the total weight of the fiber mixture, and more preferably present in an amount ranging from about 10% to about 40% by weight. Any conventional cellulosic fiber may be used in combination with the plasticized fluff pulp. Suitable conventional cellulosic fibers include any of the wood fibers mentioned previously herein, including caustic-treated fibers, rayon, cotton linters, and mixtures and combinations thereof.

In one embodiment, the absorbent core may have an upper layer comprising plasticized fluff pulp, and a lower layer comprising a composite of conventional cellulosic fibers and superabsorbent polymer. In this embodiment, the upper layer has a basis weight of about 40 gsm to about 400 gsm. The upper layer and the lower layer of the absorbent core may have the same overall length and/or the same overall width. Alternately, the upper layer may have a length that is longer or shorter than the length of the lower layer. Preferably, the length of the upper layer is 120% to 300% the length of the lower layer. The upper layer may have a width that is wider or narrower than the width of the lower layer. Preferably, the width of the upper layer is 80% the width of the lower layer.

Each layer of the absorbent core may comprise a homogeneous composition, where the plasticized fluff pulp is uniformly dispersed throughout the layer. Alternately, the plasticized fluff pulp may be concentrated in one or more areas of an absorbent core layer. In one embodiment, the single layer absorbent core contains a surface-rich layer of the plasticized fluff pulp. Preferably, the surface-rich layer has a basis weight of about 40 gsm to about 400 gsm. Preferably, the surface-rich layer has an area that is about 30% to about 70% of the total area of the absorbent core.

Although any method of making an absorbent core may be employed, preferably the absorbent core is formed by an air-laying process. Production of an absorbent core material by air-laying means is well known in the art. Typically in an air-laying process sheets of cellulosic fiber (e.g., the plasticized fluff pulp) are defiberized using a hammermill to individualize the fibers. The individualized fibers are blended in a predetermined ratio with SAP particles in a blending system and pneumatically conveyed to a series of forming chambers. The blending and distribution of absorbent materials can be controlled separately for each forming chamber. Controlled air circulation and winged agitators in each chamber produce uniform mixture and distribution of pulp and SAP. The SAP can be thoroughly and homogeneously blended throughout the web or contained only in a specific layer by distributing it to a selected forming chamber. Fibers and SAP from each forming chamber are deposited by vacuum onto a forming screen, thus forming an absorbent web. The web then is transferred from the forming screens to a carrier layer or conveyer system, and is subsequently compressed using calenders to achieve a predetermined density. The densified web may then be wound into a roll using conventional winding equipment. In another embodiment, the forming screen can optionally be covered with tissue paper as a carrier layer to reduce the loss of material. The tissue paper layer may be removed prior to calendering or may be incorporated into the formed absorbent core material.

It also is contemplated herein that an absorbent core having plasticized cellulosic fluff pulp also may be obtained by manufacturing an absorbent core, as described above, using conventional fluff pulp fiber, and thereafter applying the plasticizing formulation to the post-manufactured absorbent core. In this embodiment, the application of the plasticizing formulation may be performed, for example, by spraying, rolling, printing the plasticizing formulation onto the web of absorbent core material, or onto individualized absorbent cores that have been prepared from the web of absorbent core material.

An absorbent core containing the plasticized fluff pulp and superabsorbent polymer preferably has a dry density of between about 0.10 g/cm$^3$ and 0.50 g/cm$^3$, and more preferably from about 0.15 g/cm$^3$ to 0.45 g/cm$^3$. The absorbent core can be incorporated into a variety of absorbent articles, preferably those articles intended for body waste management, such as diapers, training pants, adult incontinence products, feminine care products, and toweling (wet and dry wipes).

One benefit of an absorbent core containing plasticized fluff pulp is that it is substantially free of hard spots. An absorbent article made from such an absorbent core is uniquely soft and comfortable among the absorbent products currently offered to the consumers. In addition, the absorbent core made with the plasticized fluff pulp fibers has been found to be more resilient than traditional absorbent cores made from conventional cellulosic fibers. As used herein, the term "resiliency" refers to the ability of the fluff pulp to recover or spring back after being compressed by common methods, thus indicating the absorbent core structural integrity. Preferably, when an absorbent core made with the plasticized fluff pulp fibers is compressed (such as by using calender rollers) it springs back to a density of less 50% of the nip density.

In order that the various embodiments may be more fully understood, the invention will be illustrated, but not limited, by the following examples. No specific details contained therein should be understood as a limitation to the present invention except insofar as may appear in the appended claims.

Test Methods:

Absorbency Test

The absorbency test was used to determine absorbent properties (absorbency under load, absorbent capacity, and centrifuge retention capacity) of plasticized fluff pulp of embodiments of the present invention. Samples of plasticized fluff pulp were defiberized by passing them through a hammer mill then tested as follows. The test was performed using a plastic cylinder with one inch inside diameter having a 100-mesh metal screen attached to the base of the cylinder. Into the cylinder was inserted a plastic spacer disk having a 0.995 inch diameter and a weighs about 4.4 g. The weight of the cylinder assembly was determined to the nearest 0.001 g ($W_0$), and then the spacer was removed from the cylinder and about 0.35 g (dry weight basis) of plasticized fluff pulp was air-laid into the cylinder. The spacer disk then was inserted back into the cylinder on the fibers, and the cylinder assembly was weighed to the nearest 0.001 g ($W_1$). Fluff pulp in the cell was compressed with a load of 4.0 psi for 60 seconds, the load then was removed and fiber pad was allowed to equilibrate for 60 seconds. The pad thickness was measured, and the result was used to calculate the dry bulk of modified fluff pulp.

A load of 0.3 psi then was placed on the spacer over the fluff pulp pad and the pad was allowed to equilibrate for 60 seconds, after which the pad thickness was measured, and the result was used to calculate the dry bulk under load of the modified fluff pulp. The cell and its contents then were hanged in a Petri dish containing sufficient amount of saline solution (0.9% by weight NaCl) to touch the bottom of the cell and the fiber was allowed to stay in contact with the saline solution for 10 minutes. Then the cell was removed and hanged in another empty Petri dish and allowed to drain for one minute. The load was removed and the weight of the cell and contents was determined ($W_2$). The weight of the saline solution absorbed per gram of fluff pulp then was calculated as shown in the following equation and the result was expressed as the "absorbency under load" (g/g).

$$\frac{W_2 - W_1}{W_1 - W_0}$$

The absorbent capacity of the plasticized fluff pulp was determined in the same manner except that the experiment was carried out under zero load. The results are used to determine the weight of the saline solution absorbed per gram fluff pulp and expressed as the "absorbent capacity" (g/g).

The cell then was centrifuged for 3 minutes at 2400 rpm (Centrifuge Model HN, International Equipment Co., Needham HTS, USA), and the weight of the cell and contents was reported ($W_3$). The centrifuge retention capacity was then calculated by dividing the weight of the fiber after centrifuge ($W_3$—$W_0$) divided by the weight of the dry fiber ($W_1$—$W_0$). The results are expressed as the "centrifuge retention capacity" (g/g).

Fiber Quality

In this test fiber content of knots, nits and fines are determined using a Fluff Fiberization Measuring Instrument (Model 9010, Johnson Manufacturing, Inc., Appleton, Wis., USA). In this test, a sample of fiber in fluff form is continuously dispersed in an air stream. During dispersion, loose fibers are passed through a 16-mesh screen (1.18 mm) and then through a 42-mesh (0.36 mm) screen. Pulp bundles that remain in the dispersion chamber (called "knots") and those that are trapped on the 42-mesh screen (called "accepts") are removed and weighed. The combined weight of these two is subtracted from the original weight of the fluff sample to determine the weight of fibers that pass through the 0.36 mm screen (called "fines.")

Kamas Energy

"Kamas energy" refers to the energy required to convert a given amount of pulp or pulp product to a fluff material, as measured in watt hours per kilogram (Wh/kg). A Kamas Lab hammermill (Kamas Industri AB, Sweden) was used to defiberize some of pulp sheet samples. Strips of pulp sheets having dimensions of 2 inches by 11 inches were fed into the hammermill, using 4200 rpm motor speed, 4.0 cm/sec feeder speed, and an 8 mm screen. The energy required to defiberize the pulp sheet is recorded, and reported as Wh/kg of fluff, the energy of defiberization.

EXAMPLES

Example 1

This example illustrates a representative method for making plasticized fluff pulp in roll form in accordance with an embodiment of present invention.

A plasticizing solution, containing 60 weight % of 1,4-CHDM (obtained from Eastman Chemical Company, Kingsport, Tenn.) in water was prepared. The plasticizing solution was applied to rolls of Rayfloc-JLD® (basis weight of 640 g/m$^2$, commercially available from Rayonier, Inc., Jesup, Ga.) by spraying using a pilot scale K&M spraying system. The plasticizing solution was applied to the sheets at various levels to produce samples of plasticized fluff pulp having about 0.5 wt %, 1.0 wt %, 1.5 wt % and 2 wt % of 1,4-CHDM based on the pulp weight. The pulp samples treated with the plasticizing solution were placed in a room with a controlled humidity for at least 4 hours, and then evaluated for absorbency and energy of defiberization (Kamas energy). The absorbency results are summarized in the following table.

TABLE 1

Absorbent properties of soft pulp of the present invention treated with various amounts of 1,4-CHDM

| Sample | Level of 1,4-CHDM on pulp (%) | Absorbent Capacity (g/g OD) | Absorbency Under Load (g/g OD) | Centrifuge Retention (g/g OD) |
|---|---|---|---|---|
| Rayfloc-JLD ® | 0 | 10.3 | 11.4 | 0.93 |
| Rayfloc-JMX | 0 | 8.7 | 10.1 | 0.88 |
| A | 0.5 | 9.8 | 10.7 | 0.93 |
| B | 1.0 | 10.2 | 11.2 | 0.96 |
| C | 1.5 | 9.5 | 11.2 | 0.94 |
| D | 2.0 | 10.0 | 11.4 | 0.90 |

Example 2

This example illustrates a representative method for making plasticized fluff pulp in roll form in accordance with an embodiment of the present invention.

A plasticizing solution containing equal amounts by weight of 1,4-CHDM (40 wt %) and triacetin (40 wt %, obtained from Vitusa Products Inc., Berkeley Hts., N.J.) in water was prepared. The plasticizing solution was sprayed onto rolls of Rayfloc-JLD® pulp, using the method described in Example 1. The solution was sprayed at various levels to afford about 0.5 wt %, 1.0 wt %, 1.5 wt % and 2.0 wt % of the plasticizing formulation (1,4-CHDM and triacetin) based on the pulp weight. The plasticized pulp samples were placed in a room with a controlled humidity for at least 4 hours, and then evaluated for absorbency and energy of defiberization (Kamas energy). The absorbency results are summarized in Table 2 below.

TABLE 2

Absorbent properties of plasticized fluff pulp of the present invention treated with various amounts of the plasticizing formulation of Example 2

| Sample | Level of Plasticizing Formulation on pulp (weight %) | Absorbent Capacity (g/g OD) | Absorbency Under Load (g/g OD) | Centrifuge Retention (g/g OD) |
|---|---|---|---|---|
| Rayfloc JLD ® | 0 | 10.3 | 11.4 | 0.93 |
| E | 0.5 | 9.7 | 10.6 | 0.95 |
| F | 1.0 | 9.7 | 11.0 | 0.97 |
| G | 1.5 | 9.6 | 11.0 | 0.93 |
| H | 2.0 | 9.3 | 10.9 | 0.92 |

Example 3

In this example, fiber quality and defiberization energy were evaluated for selected samples of the plasticized fluff pulps prepared as described above in Examples 1 and 2. The results are summarized in Table 3 below.

TABLE 3

Fiber Quality and Kamas Energy for plasticized fluff pulp samples of the present invention

| Sample | Knots and nits (%) | Kamas Energy (Wh/kg) |
|---|---|---|
| Rayfloc-JLD ® | 9.9 | 43.44 |
| B | 6.2 | 38.4 |
| E | 6.9 | 39.2 |
| F | 7.5 | 33.4 |
| G | 7.1 | 30.4 |
| H | 5.0 | 30.3 |

Example 4

In this example, the wicking rate was measured for selected samples of the plasticized fluff pulps prepared as described above in Examples 1 and 2.

The following web samples were made for testing:

Prototype 3.1: plasticized wood fluff pulp sample made in accordance with Example 2 treated with 1,4-CHDM (0.8 wt %) and triacetin (0.8 wt %).

Prototype 4.1: plasticized wood fluff pulp sample made in accordance with Example 1 treated with 1,4-CHDM (1.5 wt %).

Rayfloc-JLDE-T®: unplasticized wood fluff pulp sample (commercially available from Rayonier, Inc., Jesup, Ga.).

Rayfloc-JLD®: unplasticized wood fluff pulp sample (commercially available from Rayonier, Inc., Jesup, Ga.).

Rayfloc-JMX®: de-bonded wood fluff pulp sample (commercially available from Rayonier, Inc., Jesup, Ga.).

Hand sheet samples measuring about 12 inches by 12 inches were obtained from the plasticized fluff pulp samples and unplasticized fluff pulp samples. Each hand sheet sample was disintegrated into fluff pulp using a Kamas mill (Kamas Industri AB, Sweden). A sample of the fluff pulp was airlaid to a hand web having dimensions of about 16 inches by 16 inches, then compressed to a density of about 0.2 g/cc. Testing sample strips were cut from the air-laid web, with dimensions of about 9 inches by 2 inches. Each sample strip was cut at least about 1 inch away from the edge of the hand sheet so as to avoid edge effects. The samples then were subjected to a horizontal wicking test to determine the wicking rate, or the rate at which water is drawn in the horizontal direction by a strip of an absorbent material. The wicking rate was determined as follows. A test sample was sandwiched between two polyester support webs, and squeezed with clamps to obtain a testing sample with a density of about 0.15 g/cc. The sample was then placed on top of a board containing an insult reservoir with a 10" inside diameter. Fluid uptake capacity was measured every second for about 5 minutes using a special computer software program. The amount of fluid uptake (g saline) per time (sec) data were recorded for each sample and plotted as shown in FIG. 1.

FIG. 1 shows the horizontal wicking of the plasticized fluff pulp versus conventional an untreated fluff pulp and de-bonded fluff pulp. As shown in FIG. 1, the fluid transfer properties of the fluff pulp are not affected by treatment with the plasticizing formulation of the present invention. The results demonstrate that plasticized fluff pulp has the same wicking properties as conventional fluff pulp and more than a 30% increase in horizontal wicking over de-bonded fluff pulp.

Example 5

This example was designed to evaluate the effect of plasticized fluff pulp on the softness and resiliency of an absorbent core. Resiliency refers to the ability of the absorbent core to expand to original density after release from compressional force. Resiliency of an absorbent core is related to the ability to make absorbent cores without hard spots.

Various absorbent core samples were constructed using a mixture of the above fluff pulps (plasticized and un-plasticized) and SAP particles. The absorbent cores were constructed using a bench-scale dry-forming system. The bench-scale dry-forming system is used to produce a 14-inch×16-inch handsheet of absorbent core. This system allows varying the number of layers, amount of superabsorbent polymer (SAP), pulp type and content, basis weight and density of the absorbent cores formed. The bench-scale dry-forming system can be used to produce multi-layered air-laid handsheet and mimics a large-scale air-laid pilot plant. The system comprises of a Kamas mill to defiberize the pulp, a 100-mesh, 14-inch forming wire in a vacuum forming head, a SAP dosing system, compaction roll for initial densification of web and a press for final densification.

A series of absorbent core samples having a basis weight of 850 g/m$^2$ were prepared in accordance with above procedure using the various plasticized and unplasticized fluff pulps as described below:

Prototype 3.1: absorbent core sample containing plasticized wood fluff pulp (Rayfloc-JLD®) made in accordance with Example 2 treated with 1,4-CHDM (0.8 wt %) and triacetin (0.8 wt %).

Prototype 4.1: absorbent core sample containing wood fluff pulp (Rayfloc-JLD®) made in accordance with Example 1 treated with 1,4-CHDM (1.5 wt %).

Prototype 5.1: absorbent core sample containing wood fluff pulp (Rayfloc-JLD®) treated by spraying with triacetin (2.0 wt %) in aqueous solution.

Rayfloc-JLD®: unplasticized wood fluff pulp sample (commercially available from Rayonier, Inc., Jesup, Ga.).

The overall composition of each core sample was 60 wt % fluff pulp and 40 wt % superabsorbent material (BASF 2600). The resultant webs were then pressed (at 100 psi) by passing them through an M/K sheet press (Motor Master 20000-series, M/K System Inc., Glendale, Calif.). The sheet press was modified to be fixed at various nip gaps by placing appropriate shims between the nip rolls and between the air pistons and the bearings to the nip roll. The nip gap was used to determine the nip density of the pressed web. After being pressed, the web was left sitting for about 10 minutes to reach equilibrium and the final thickness was measured. The final thickness was then used to determine the final density of the web. Resultant webs were also evaluated for hard spots and various properties such as resiliency and softness.

Figure 2:
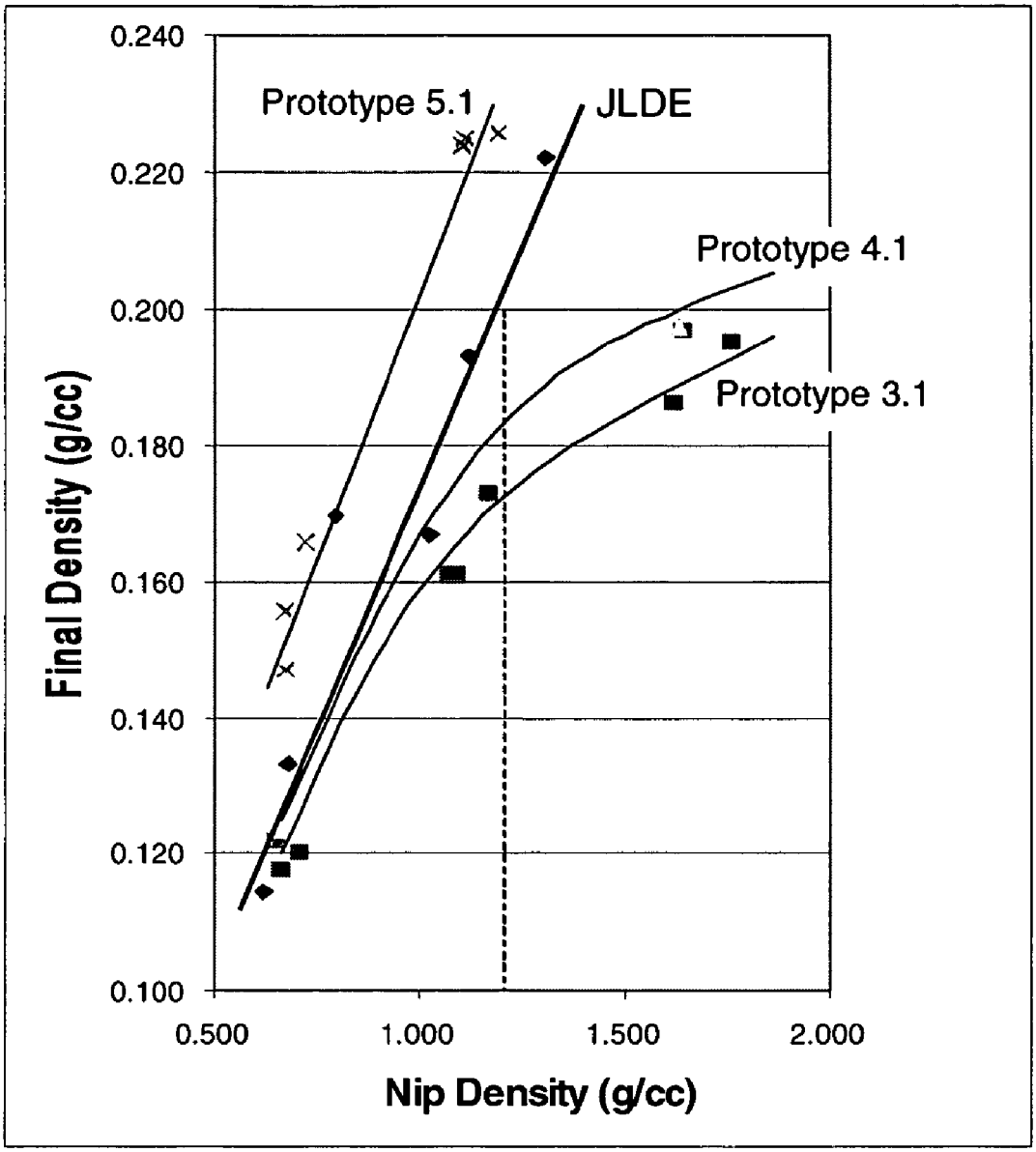
FIG. 2 is a plot showing the resiliency of absorbent core samples made using plasticized and conventional fluff pulp as described in Example 5.

The spring back test was conducted on each of the three plasticized fluff pulp samples above, and a control sample (unplasticized Rayfloc-JLDE®). After the samples were subjected to compression at various nip gaps, the nip densities and final densities were measured. The final density is plotted as a function of the nip density in FIG. 2. As can be seen from FIG. 2 the air-laid webs formed from conventional fiber such as Rayfloc-JLDE® and fiber treated with triacetin have a linear relation between the final density and the nip density. In comparison, the webs formed from the plasticized fluff pulp (Prototypes 3.1 and 4.1) have a linear relation until about 1.2 g/cc nip density, beyond which the final density levels off. These results demonstrate that the air-laid webs formed from plasticized fluff pulp are softer and have higher spring back than webs formed from conventional fiber.

Example 6

This example illustrates the effect of plasticized fluff pulp on the stiffness of an absorbent core, as measured by the cup crush test method.

Figure 3A:
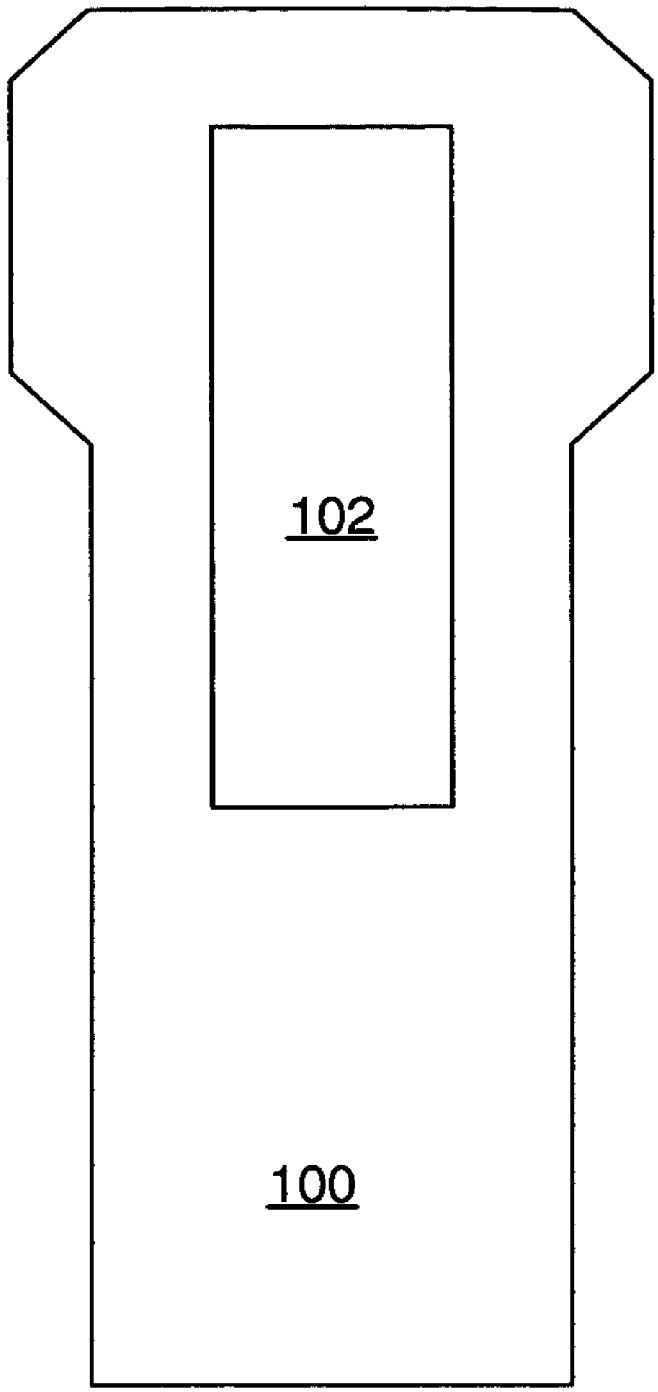
FIG. 3*a* is a top view of an airlaid absorbent core, showing how a sample is prepared for the cup crush test method, as described in Example 6.
Figure 3B:
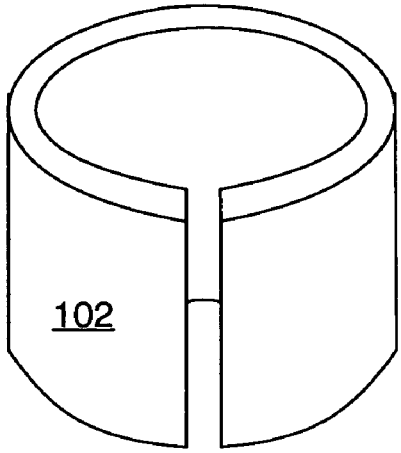
FIG. 3*b* shows how a sample is prepared for the cup crush test method, as described in Example 6.
Figure 3C:
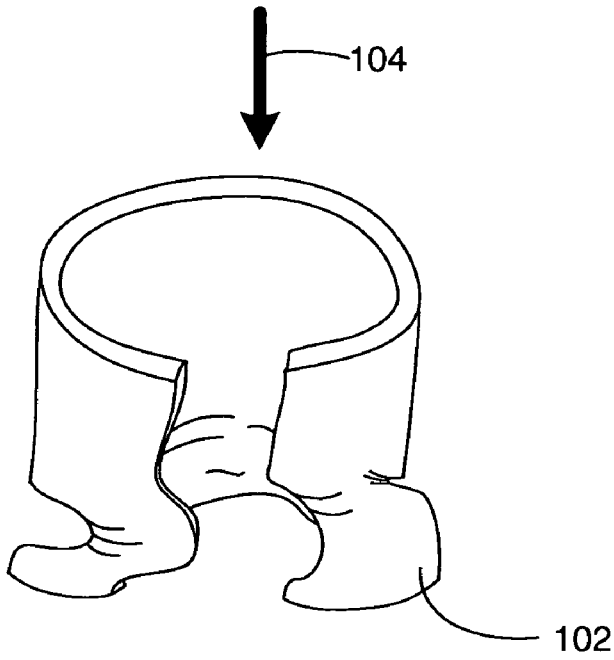
FIG. 3*c* shows how compressive force is applied to the test sample for the cup crush test method, as described in Example 6.

The cup crush test was performed using an Instron Model 1122 Universal Test Instrument. The test evaluates absorbent core stiffness by measuring the peak load required for a 4.5 cm diameter hemispherically shaped foot to crush an 18.5 cm by 9.0 cm sample of absorbent core obtained from an airlaid web and rolled into a cylindrical shape with a circumference of a 60 mm. As shown in FIG. 3*a*, a test sample 102 was prepared by cutting a strip measuring about 18.5 cm by 9.0 cm from an airlaid core 100. The test sample 102 was then rolled into a cylindrical sample having a circumference of about 60 mm (see FIG. 3*b*). The cylindrical sample was placed in a plastic cup with a diameter of 60 mm allowing about 4.4 cm of the sample to extend beyond the top edge of the cup. The cup is used as a support to immobilize the core sample and maintain a uniform deformation of the core sample. As illustrated in FIG. 3*c*, compressive force 104 was applied to the test sample 102 by the hemispherically shaped foot. The peak load was measured while the foot was descending at a rate of about 10.0 mm/min until the maximum compression load of about 45 Newton was reached at a target height of approximately 40.0 mm. The compression force (N) versus the compression extension (mm) data obtained from the test were collected and analyzed.

Absorbent core samples were prepared in accordance with above procedure using the fluff pulps as described below:

Prototype 3.1: absorbent core sample containing wood fluff pulp (Rayfloc-JLD®) made in accordance with Example 2 treated with 1,4-CHDM (0.8 wt %) and triacetin (0.8 wt %).

Rayfloc-JLD®: unplasticized conventional wood fluff pulp sample (commercially available from Rayonier, Inc., Jesup, Ga.).

Figure 4:
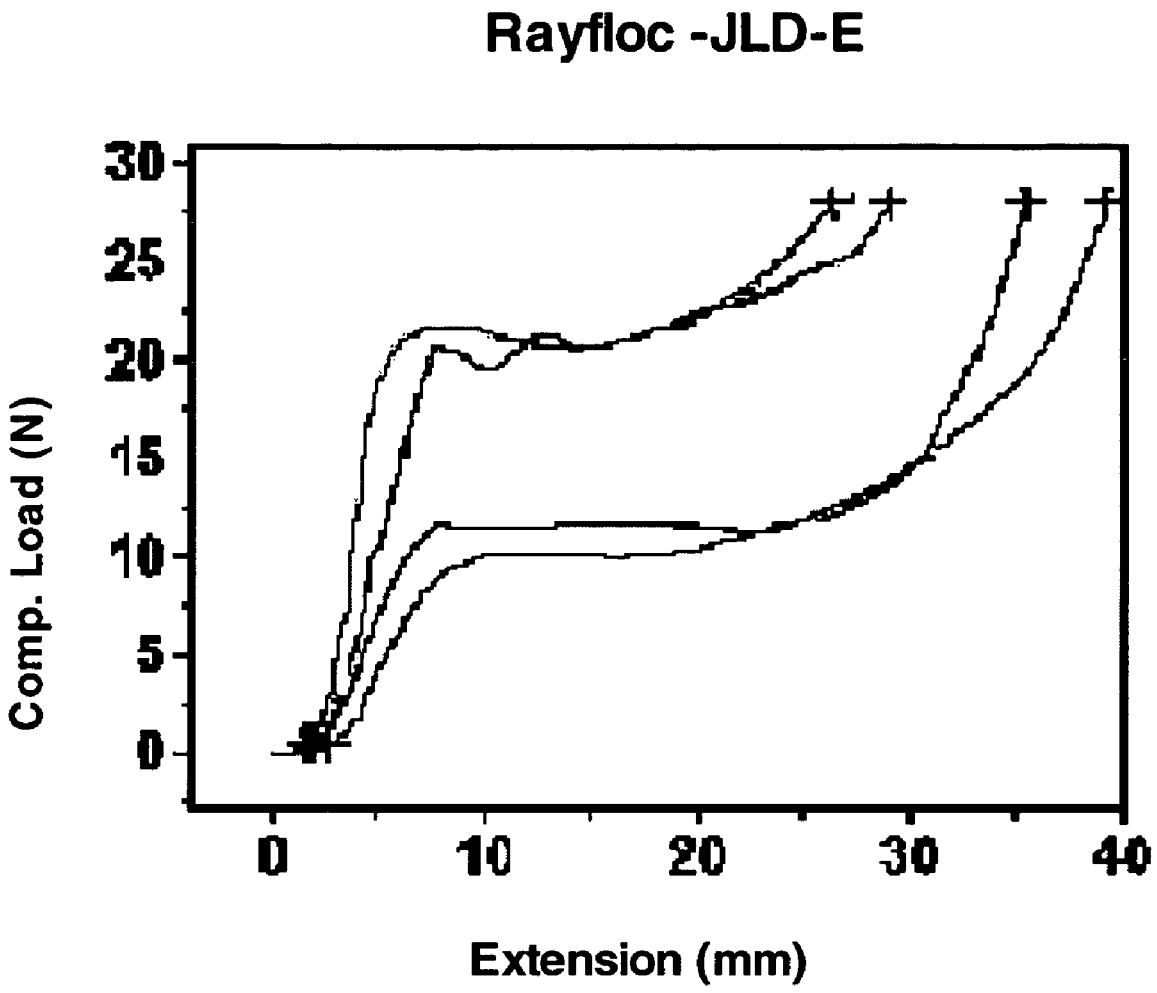
FIG. 4 is a plot showing the cup crush test results for conventional fluff pulp samples, as described in Example 6.
Figure 5:
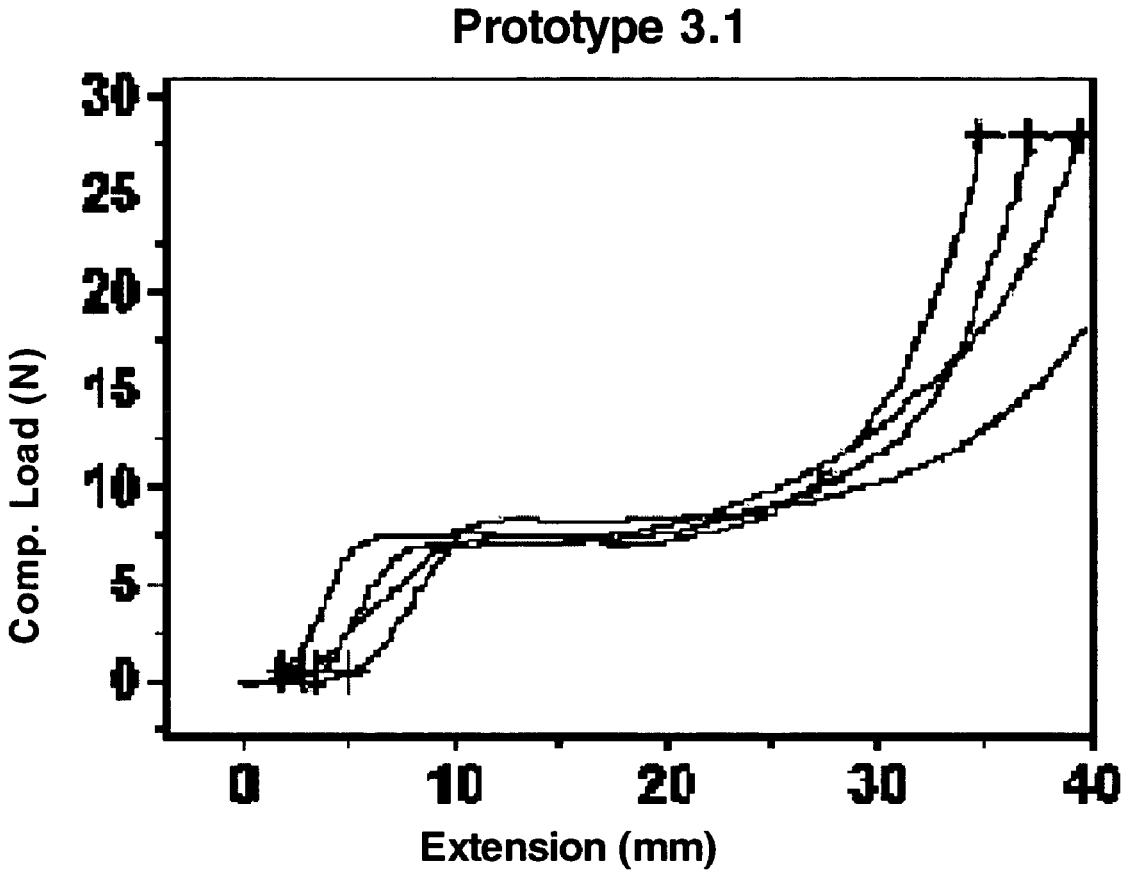
FIG. 5 is a plot showing the cup crush test results for plasticized fluff pulp samples, as described in Example 6.

Absorbent core samples were tested as described above in the cup crush test. The results of the cup crush test for the Rayfloc-JLD® samples are shown in FIG. 4, and the results for the plasticized fluff pulp samples are shown in FIG. 5. Each figure shows four runs of each sample.

Referring now to the results in FIG. 4, two of the absorbent core samples containing Rayfloc-JLD® exhibited a high force to crush (approximately 20N-22N). This indicates a high content of hard spots. In contrast, the results shown in FIG. 5 show that the absorbent core samples containing plasticized fluff pulp have a substantially lower force to crush (about 7N), indicating few or no hard spots. Therefore, for the purposes of the embodiments of this invention, a low crush force is a preferred property for a flexible absorbent core, provided that the absorbent core is soft.

While the invention has been described with reference to particularly preferred embodiments and examples, those skilled in the art recognize that various modifications may be made to the invention without departing from the spirit and scope thereof.

What is claimed is:

1. A method for making plasticized fluff pulp, comprising:

providing a cellulosic fluff pulp base fiber;

providing a plasticizing formulation comprising a mixture of a primary plasticizing agent that is water soluble, non-ionic and non-polymeric and a secondary plasticizing agent; and applying the plasticizing formulation to the cellulosic fluff pulp base fiber to provide a plasticized fluff pulp, wherein the primary plasticizing agent prevents the cellulosic fluff pulp base fibers from forming bonds with other cellulosic fluff pulp fibers or superabsorbent polymer;

wherein the plasticized fluff pulp has a final density that is lower than that of the non-plasticized cellulosic fluff pulp base fiber when the respective fluff pulp samples are defiberized, blended with superabsorbent polymer, highly compressed, and then released; and wherein the primary plasticizing agent is 1,2-cyclohexanedimethanol, 1,3-cyclohexanedimethanol, 1,4-cyclohexanedimethanol, or a mixture or combination thereof.

2. The method of claim 1, wherein the plasticizing formulation is provided in an aqueous solution.

3. The method of claim 1, wherein the plasticizing formulation comprises from about 0.25 weight % to about 50 weight % of an antimicrobial agent.

4. The method of claim 3, wherein the antimicrobial agent is a substance active against gram-negative bacteria.

5. The method of claim 3, wherein the antimicrobial agent is selected from the group consisting of: salicylic acid-N-octyl amide, salicylic acid-N-decyl amide, 2,4,4'-trichloro-2'-hydroxydiphenyl ether (triclosan), 4-chloro-3,5-dimethylphenol, piroctone ethanolamine salt, tetracycline, 3,4,4'-trichlorobanilide, antimicrobially active perfumes, and mixtures and combinations thereof.

6. The method of claim 3, wherein the plasticizing formulation is applied to the cellulosic fluff pulp base fiber to provide from about 0.001 weight % to about 0.5 weight % antimicrobial agent on fiber, based on the total weight of the fiber.

7. The method of claim 3, wherein the plasticizing formulation is applied to the cellulosic fluff pulp base fiber to provide from about 0.05 weight % to about 3 weight % of plasticizing formulation on fiber, based on the total weight of the fiber, and from about 0.003 weight % to about 0.06 weight % antimicrobial agent on fiber, based on the total weight of the fiber.

8. The method of claim 1, wherein applying the plasticizing formulation comprises spraying, dipping, rolling, or applying with a puddle press, size press or a blade-coater.

9. The method of claim 1, wherein the plasticizing formulation is applied to the cellulosic fluff pulp base fiber to provide from about 0.05 weight % to about 3.0 weight % of plasticizing formulation on fiber, based on the total weight of the fiber.

10. The method of claim 1, wherein the cellulosic fluff pulp base fiber is provided in sheet form.

11. The method of claim 1, wherein the cellulosic fluff pulp base fiber is provided in fluff form.

12. The method of claim 1, wherein the cellulosic fluff pulp base fiber is provided in stabilized resin-bonded or thermal-bonded non-woven mat.

13. The method of claim 1, wherein the cellulosic fluff pulp base fiber is a conventional cellulose fiber.

14. The method of claim 13, wherein the conventional cellulose fiber is a wood pulp fiber obtained from a Kraft or sulfite chemical process.

15. The method of claim 14, wherein the wood pulp fiber is obtained from a hardwood cellulose pulp, a softwood cellulose pulp, or a combination or mixture thereof.

16. The method of claim 15, wherein the hardwood cellulose pulp is selected from the group consisting of: gum, maple, oak, eucalyptus, poplar, beech, aspen, and combinations and mixtures thereof.

17. The method of claim 15, wherein the softwood cellulose pulp is selected from the group consisting of: Southern pine, White pine, Caribbean pine, Western hemlock, spruce, Douglas fir, and mixtures and combinations thereof.

18. The method of claim 13, wherein the cellulosic fluff pulp base fiber is derived from cotton linters, bagasse, kemp, flax, grass, CTMP, cross-linked fibers or combinations or mixtures thereof.

19. The method of claim 1, wherein the cellulosic fluff pulp base fiber is a caustic-treated fiber.

20. A method for making plasticized fluff pulp, comprising:

providing a cellulosic fluff pulp base fiber;

providing a plasticizing formulation comprising a mixture of a primary plasticizing agent that is water soluble, non-ionic and non-polymeric and a secondary plasticizing agent; and applying the plasticizing formulation to the cellulosic fluff pulp base fiber to provide a plasticized fluff pulp, wherein the primary plasticizing agent prevents the cellulosic fluff pulp base fibers from forming bonds with other cellulosic fluff pulp fibers or superabsorbent polymer;

wherein the plasticized fluff pulp has a final density that is lower than that of the non-plasticized cellulosic fluff pulp base fiber when the respective fluff pulp samples are defiberized, blended with superabsorbent polymer, highly compressed, and then released; and wherein the plasticizing formulation comprises from about 5 weight % to about 49 weight % of the primary plasticizing agent, and from about 51 weight % to about 95 weight % of the secondary plasticizing agent.

21. The method of claim 1, wherein the secondary plasticizing agent is a polyhydroxy compound, an ether derivative of a polyhydroxy compound, an ester derivative of a polyhydroxy compound, or a mixture or combination thereof.

22. The method of claim 20, wherein the primary plasticizing agent is cyclohexanedimethanol and the secondary plasticizing agent is triacetin, diacetin, propylene glycol, dipropylene glycol, tripropylene glycol, polyethylene glycol, glycerol, polyethylene glycol methyl ether, pentaerythritol ethoxylate, pentaerythritol propoxylate, 2-phenoxyethanol, or a mixture or combination thereof.

23. The method of claim 1, wherein the plasticizing formulation comprises from about 30 weight % to about 60 weight % of cyclohexanedimethanol, from about 30 weight % to about 60 weight % of a secondary plasticizing agent, and from about 0.25 weight % to about 50 weight % of an antimicrobial agent.

24. A method for making plasticized fluff pulp, comprising:

providing a cellulosic fluff pulp base fiber;

providing a plasticizing formulation comprising a mixture of a primary plasticizing agent that is water soluble, non-ionic and non-polymeric and a secondary plasticizing agent; and applying the plasticizing formulation to the cellulosic fluff pulp base fiber to provide a plasticized fluff pulp, wherein the primary plasticizing agent prevents the cellulosic fluff pulp base fibers from forming bonds with other cellulosic fluff pulp fibers or superabsorbent polymer;

wherein the plasticized fluff pulp has a final density that is lower than that of the non-plasticized cellulosic fluff pulp base fiber when the respective fluff pulp samples are defiberized, blended with superabsorbent polymer, highly compressed, and then released; and wherein the plasticizing formulation comprises from about 5 weight % to about 10 weight % of the primary plasticizing agent, from about 5 weight % to about 95 weight % of the secondary plasticizing agent, and from about 0.25 weight % to about 50 weight % antimicrobial agent.

25. The method of claim 1, wherein the secondary plasticizing agent is triacetin, diacetin, propylene glycol, dipropylene glycol, tripropylene glycol, polyethylene glycol, glycerol, polyethylene glycol methyl ether, pentaerythritol ethoxylate, pentaerythritol propoxylate, 2-phenoxyethanol, or a mixture or combination thereof.

26. The method of claim 20, wherein the plasticizing formulation is provided in an aqueous solution.

27. The method of claim 20, wherein the plasticizing formulation comprises from about 0.25 weight % to about 50 weight % of an antimicrobial agent.

28. The method of claim 27, wherein the antimicrobial agent is a substance active against gram-negative bacteria.

29. The method of claim 27, wherein the antimicrobial agent is selected from the group consisting of: salicylic acid-N-octyl amide, salicylic acid-N-decyl amide, 2,4,4'-trichloro-2'-hydroxydiphenyl ether (triclosan), 4-chloro-3,5-dimethylphenol, piroctone ethanolamine salt, tetracycline, 3,4,4'-trichlorobanilide, antimicrobially active perfumes, and mixtures and combinations thereof.

30. The method of claim 27, wherein the plasticizing formulation is applied to the cellulosic fluff pulp base fiber to provide from about 0.001 weight % to about 0.5 weight % antimicrobial agent on fiber, based on the total weight of the fiber.

31. The method of claim 27, wherein the plasticizing formulation is applied to the cellulosic fluff pulp base fiber to provide from about 0.001 weight % to about 0.5 weight % antimicrobial agent on fiber, based on the total weight of the fiber.

32. The method of claim 20, wherein applying the plasticizing formulation comprises spraying, dipping, rolling, or applying with a puddle press, size press or a blade-coater.

33. The method of claim 20, wherein the plasticizing formulation is applied to the cellulosic fluff pulp base fiber to provide from about 0.05 weight % to about 3.0 weight % of plasticizing formulation on fiber, based on the total weight of the fiber.

34. The method of claim 20, wherein the cellulosic fluff pulp base fiber is provided in sheet form.

35. The method of claim 20, wherein the cellulosic fluff pulp base fiber is provided in fluff form.

36. The method of claim 20, wherein the cellulosic fluff pulp base fiber is provided in stabilized resin-bonded or thermal-bonded non-woven mat.

37. The method of claim 20, wherein the cellulosic fluff pulp base fiber is a conventional cellulose fiber.

38. The method of claim 37, wherein the conventional cellulose fiber is a wood pulp fiber obtained from a Kraft or sulfite chemical process.

39. The method of claim 38, wherein the wood pulp fiber is obtained from a hardwood cellulose pulp, a softwood cellulose pulp, or a combination or mixture thereof.

40. The method of claim 39, wherein the hardwood cellulose pulp is selected from the group consisting of: gum, maple, oak, eucalyptus, poplar, beech, aspen, and combinations and mixtures thereof.

41. The method of claim 39, wherein the softwood cellulose pulp is selected from the group consisting of: Southern pine, White pine, Caribbean pine, Western hemlock, spruce, Douglas fir, and mixtures and combinations thereof.

42. The method of claim 20, wherein the cellulosic fluff pulp base fiber is derived from cotton linters, bagasse, kemp, flax, grass, CTMP, cross-linked fibers or combinations or mixtures thereof.

43. The method of claim 20, wherein the cellulosic fluff pulp base fiber is a caustic-treated fiber.

44. The method of claim 20, wherein the primary plasticizing agent is 1,2-cyclohexanedimethanol, 1,3-cyclohexanedimethanol, 1,4-cyclohexanedimethanol, or a mixture or combination thereof.

45. The method of claim 24, wherein the antimicrobial agent is selected from the group consisting of: salicylic acid-N-octyl amide, salicylic acid-N-decyl amide, 2,4,4'-trichloro-2'-hydroxydiphenyl ether (triclosan), 4-chloro-3,5-dimethylphenol, piroctone ethanolamine salt, tetracycline, 3,4,4'-trichlorobanilide, antimicrobially active perfumes, and mixtures and combinations thereof.

46. The method of claim 24, wherein the plasticizing formulation is applied to the cellulosic fluff pulp base fiber to provide from about 0.001 weight % to about 0.5 weight % antimicrobial agent on fiber, based on the total weight of the fiber.

47. The method of claim 24, wherein the plasticizing formulation is applied to the cellulosic fluff pulp base fiber to provide from about 0.05 weight % to about 3.0 weight % of plasticizing formulation on fiber, based on the total weight of the fiber.

48. The method of claim 24, wherein the cellulosic fluff pulp base fiber is provided in sheet form.

49. The method of claim 24, wherein the cellulosic fluff pulp base fiber is provided in fluff form.

50. The method of claim 24, wherein the cellulosic fluff pulp base fiber is provided in stabilized resin-bonded or thermal-bonded non-woven mat.

51. The method of claim 24, wherein the primary plasticizing agent is 1,2-cyclohexanedimethanol, 1,3-cyclohexanedimethanol, 1,4-cyclohexanedimethanol, or a mixture or combination thereof.

* * * * *